US009518462B2

(12) United States Patent
Downie et al.

(10) Patent No.: US 9,518,462 B2
(45) Date of Patent: Dec. 13, 2016

(54) TURBINE FOR TRANSMITTING ELECTRICAL DATA

(71) Applicant: HALLIBURTON ENERGY SERVICES, INC., Houston, TX (US)

(72) Inventors: Andrew McPherson Downie, Dunfermline (GB); Geoffrey Andrew Samuel, Edmonton (CA); Christopher Paul Crampton, Alva (GB)

(73) Assignee: HALLIBURTON ENERGY SERVICES INC., Houston, TX (US)

( * ) Notice: Subject to any disclaimer, the term of this patent is extended or adjusted under 35 U.S.C. 154(b) by 0 days.

(21) Appl. No.: 14/397,110

(22) PCT Filed: Dec. 18, 2013

(86) PCT No.: PCT/US2013/076287

§ 371 (c)(1),
(2) Date: Oct. 24, 2014

(87) PCT Pub. No.: WO2015/094251

PCT Pub. Date: Jun. 25, 2015

(65) Prior Publication Data

US 2015/0308262 A1 Oct. 29, 2015

(51) Int. Cl.

| | |
|---|---|
| ***E21B 47/12*** | (2012.01) |
| ***F03B 13/02*** | (2006.01) |
| ***E21B 47/18*** | (2012.01) |

(52) U.S. Cl.

CPC ..... *E21B 47/12* (2013.01); *E21B 47/182* (2013.01); *F03B 13/02* (2013.01)

(58) Field of Classification Search

CPC ..... E21B 4/02; E21B 17/003; E21B 17/02; E21B 17/028; E21B 41/00; E21B 41/0085; E21B 43/00; E21B 47/12; E21B 47/122; E21B 47/182; G01V 3/00; H01R 39/00; H01R 39/646; F03B 13/02

USPC ..... 340/853.1–856.4; 175/40, 45, 48; 439/11–22; 415/415

See application file for complete search history.

(56) References Cited

U.S. PATENT DOCUMENTS

| | | | |
|---|---|---|---|
| 4,667,751 | A | 5/1987 | Geczy et al. |
| 4,909,741 | A | 3/1990 | Schasteen et al. |
| 5,160,925 | A | 11/1992 | Dailey et al. |

(Continued)

OTHER PUBLICATIONS

International Search Report and Written Opinion mailed Sep. 1, 2014. In corresponding application No. PCT/US2013/076287.

*Primary Examiner* — Brian Wilson
(74) *Attorney, Agent, or Firm* — Polsinelli PC

(57) ABSTRACT

The turbine (100) can be used to transmit electrical data signals, for example, sensor data signals, across a down hole turbine using, with the data signals be communicated via a shaft (102). As a result, a signal can be induced onto the shaft (102) from a lower end of the shaft (102), for example, motor shaft, to an upper end of the shaft (102). The signal can be induced on the shaft (102) by a first induction loop (112) and can be picked up by a second induction loop (114) with the first induction loop (112) being downhole from the second induction loop (114). The second induction loop (114) can be communicatively coupled to a receiver (712) which can pass the signals passed to a transmitter (712), for example, a measurement while drilling (MWD) unit. The MWD unit can then process the signal and transmit the signal to the surface.

20 Claims, 8 Drawing Sheets

(56) References Cited

U.S. PATENT DOCUMENTS

| | | | | |
|---|---|---|---|---|
| 6,392,561 | B1 * | 5/2002 | Davies | E21B 4/02 340/853.3 |
| 6,540,032 | B1 | 4/2003 | Krueger | |
| 8,162,044 | B2 * | 4/2012 | Sihler | E21B 4/02 166/105 |
| 2003/0213620 | A1 | 11/2003 | Krueger | |
| 2004/0119607 | A1 * | 6/2004 | Davies | E21B 4/02 340/854.4 |
| 2006/0131079 | A1 * | 6/2006 | Bottos | E21B 4/02 175/107 |
| 2007/0018848 | A1 | 1/2007 | Bottos et al. | |
| 2013/0200299 | A1 | 8/2013 | Mazyar et al. | |
| 2014/0119974 | A1 * | 5/2014 | Kitching | F01C 21/08 418/191 |
| 2015/0354280 | A1 * | 12/2015 | Downton | E21B 4/02 175/107 |

* cited by examiner

TURBINE FOR TRANSMITTING ELECTRICAL DATA

CROSS-REFERENCE TO RELATED APPLICATIONS

This application is a national stage entry of PCT/US2013/076287 filed Dec. 18, 2013, said application is expressly incorporated herein in its entirety.

FIELD

The subject matter herein generally relates to a turbine for transmitting electrical data from one end of the turbine to another end of the turbine and more specifically, transmitting electrical data via a shaft within the turbine and/or via the turbine body.

BACKGROUND

In drilling a well, the drillstring can include one or more sensors to detect changes in the well and/or wellbore. The drilling operation can limit the location of the sensors.

BRIEF DESCRIPTION OF THE DRAWINGS

Implementations of the present technology will now be described, by way of example only, with reference to the attached figures, wherein.

DETAILED DESCRIPTION

Figure 1:
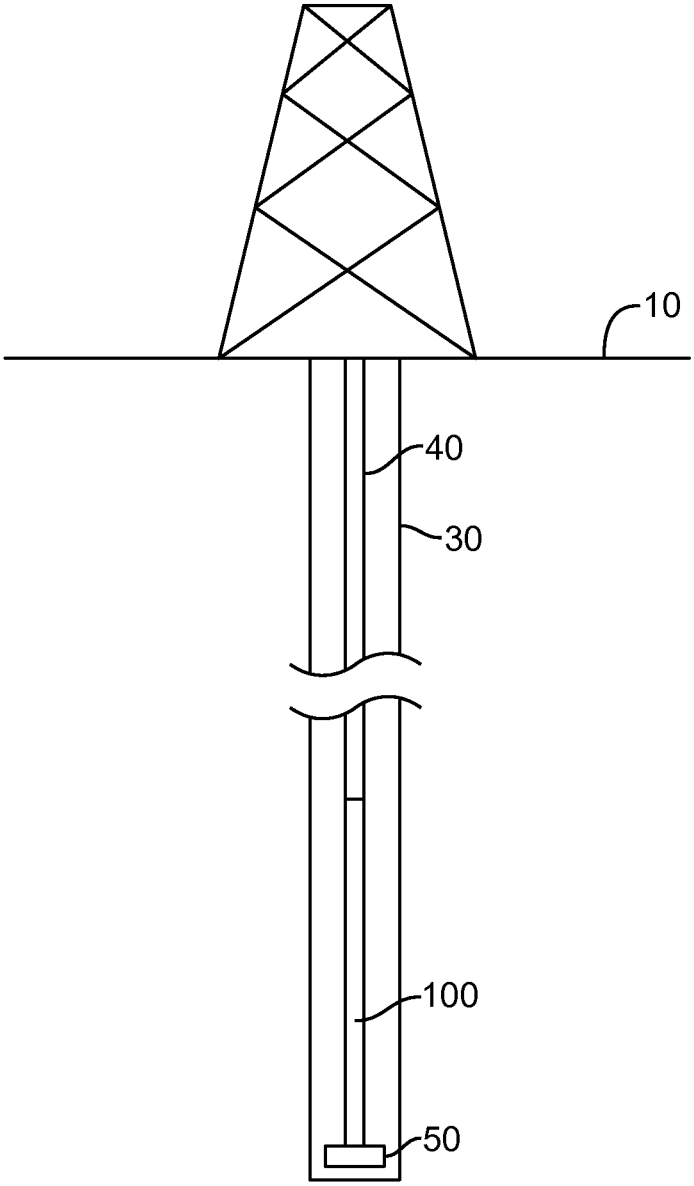
FIG. 1 is a diagram of a well including a wellbore and a turbine in accordance with an exemplary embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the following description, terms such as "upper," "upward," "lower," "downward," "above," "below," "downhole," "uphole," "longitudinal," "lateral," and the like, as used herein, shall mean in relation to the bottom or furthest extent of, the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrated embodiments are illustrated such that the orientation is such that the right-hand side is downhole compared to the left-hand side.

Several definitions that apply throughout this disclosure will now be presented. The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicate that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

The present disclosure is described in relation to an exemplary turbine which can be used to transmit electrical data signals, for example sensor data signals, across a downhole turbine using the motor shaft as a leg of a first conducting path and the turbine body as a leg of a second conductor path. As a result, a signal can be induced onto the shaft from a lower end of the shaft, for example, motor shaft, to an upper end of the shaft. The signal can be picked up, for example, induced, from the upper end of the shaft by a receiver and then passed to a transmitter, for example, a transmitter can be included in a measurement while drilling (MWD) unit. When the transmitter is included in a MWD unit, the MWD unit can include one or more additional components to process signals. Additionally, the MWD can also be configured to receive signals from an operation controller at the surface or other position upstream of the MWD unit.

In one example, the MWD unit can process the signal and transmit the signal to the surface using MWD communication, which can be mud pulses or other telemetry systems. In other implementations, the MWD can communicate using wireless or wired electrical, optical and/or magnetic couplings. In one or more embodiments, a first inductive loop or circuit can be positioned at one distal end of the motor and a second inductive loop or circuit can be position at the other distal end of the motor. In one or more embodiments, the shaft can include a channel with an insulated wire residing in the channel with the sensor data being transmitted via the insulated wire. As a result, one or more sensor units can be positioned about at the motor and/or downhole from the motor and provide communication to a communication unit uphole from the sensor unit, and which is to be transmitted to the surface.

Referring to FIG. 1, an example of a well according to the present technology is illustrated. As illustrated, the wellbore 30 extends into the earth from the surface 10. A drill string 40 extends through the wellbore and includes a turbine 100 and a drill bit 50 at a distal end. The drill bit is configured to cut into or otherwise remove material from the surrounding formation so that the wellbore 30 can be formed. The turbine 100 can be coupled to the drill bit 50 as illustrated. In other embodiments, the turbine can be coupled to another component at the downhole end and in turn coupled to the drill bit 50. In other embodiments, one or more components can be coupled between the turbine 100 and the drill bit 50.

Figure 2:
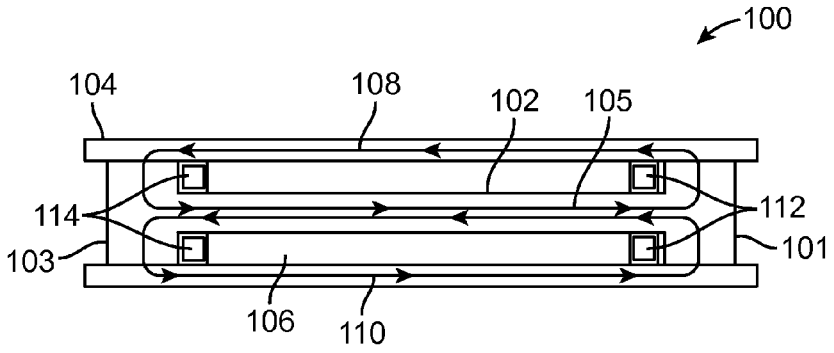
FIG. 2 is a partial view of a turbine in accordance with an exemplary embodiment.

Referring to FIG. 2, a partial view of a turbine in accordance with an exemplary embodiment is illustrated. As shown, the partial view is of a motor section of a turbine 100. The turbine 100 can include a shaft 102 residing in a turbine body 104. In some embodiments, the shaft 102 can include a first end 101 that is configured to be located downhole of a second end 103. Additionally, the shaft can include an intermediary portion 105 that couples the first end 101 with the second end 103. In at least one embodiment, such as the one illustrated in FIG. 2, a diameter of the intermediary portion 105 can be less than a diameter of the first end 101 and the second end 103. Although shown, with the shaft 102 in the center of the turbine body 104, the shaft 102 does not need to be in the center of the turbine body 104. The shaft 102 can be a rotating shaft, for example, a motor shaft. A motor 106 can be located within the turbine 100. The motor 106 can include a rotor/stator bundle (shown in FIG. 3). The rotor/stator bundle can include a plurality of rotors, stators and bearings. The plurality of rotors, stators and bearings can be interposed between the shaft 102 and the turbine body 104. As shown, the motor 106 can be interposed between a first end 101 and a second end 103 of the turbine 100.

One or more sensor units 12 (shown in FIGS. 11A and 11B) can be positioned downhole from the motor 106. Data from the sensor units 12, for example, sensor data, can be transmitted via the shaft 102 from the downhole side of the motor 106, across the motor 106 to the uphole side of the motor 106. The sensor units 12 can be configured to determine data that can include formation parameters and/or tool operating parameters, such as type of formation, rotational speed, formation fluid detection, slip detection and other parameters. In one or more embodiments, one or more sensor units 12 can be positioned at about the motor 106. The one or more sensor units 12 can include at least one of motor parameters, formation parameters and tool operating parameters. For example, the sensor data can be motor data. The sensor data can be transmitted via the shaft 102 from a sensor unit 12 at about the motor 106 through the motor 106 to the uphole side of the motor 106. In one or more embodiments, one or more sensor units 12 can be positioned uphole from the motor 106.

As shown in FIG. 2, a first signal path 108 can be generated via the shaft 102 and the turbine body 104 if the signal path is shorted to the turbine body 104. A second signal path 110 can be generated via the shaft 102 and the turbine body 104 if the signal path is shorted to the turbine body 104. The shorts (not shown) between the shaft 102 and the turbine body 104 can be accomplished via a short circuit, for example, a jumper wire, slip rings, contact bearings or other means. As a result, the shaft 102 can be used to pass sensor data across the motor 106.

In one or more embodiments, a first inductive loop 112 can be used to induce a signal on the shaft 102 and a second inductive loop 114 can be used to receive the signal from the shaft 102. The first inductive loop 112 and the second inductive loop 114 can be one or more toroids, toroid coils, coils, slip rings or any other component that can induce a current onto the shaft 102. The first inductive loop 112 can be downhole from the second inductive loop 114. For example, the first inductive loop 112 can induce current signals which travel on the shaft 102, for example, via the first signal path 108, and the second inductive loop 114 can receive the induced current signals from the shaft 102. By varying the current, data, such as sensor data, can be provided from one or more sensor units 12, across the motor 106 and to the surface 10. The first inductive loop 112 can be interposed between the motor 106 and the one or more sensor units 12. The second inductive loop 114 can be interposed between the motor 106 and a transmitter 712 (shown in FIG. 11A). The transmitter 712, such as a MWD unit or other telemetry device can be used to transmit the data to the surface using known means in the art.

Given that conventional turbines contain metal rotors, stators and bearings, such components provide multiple potential paths and large surface areas for leakage of the current hence loss of signal. To assist in reducing such signal loss, one or more non-conducting insulators or electrical insulators can be used. For example, one or more electrical insulators can be interposed between the shaft 102 and the turbine body 104 to assist in reducing leakage paths along the shaft. In another example, one or more electrical insulators can be used to isolate the shaft 102 and/or the turbine body 104 from the rotors, stators and bearings.

Figure 3:
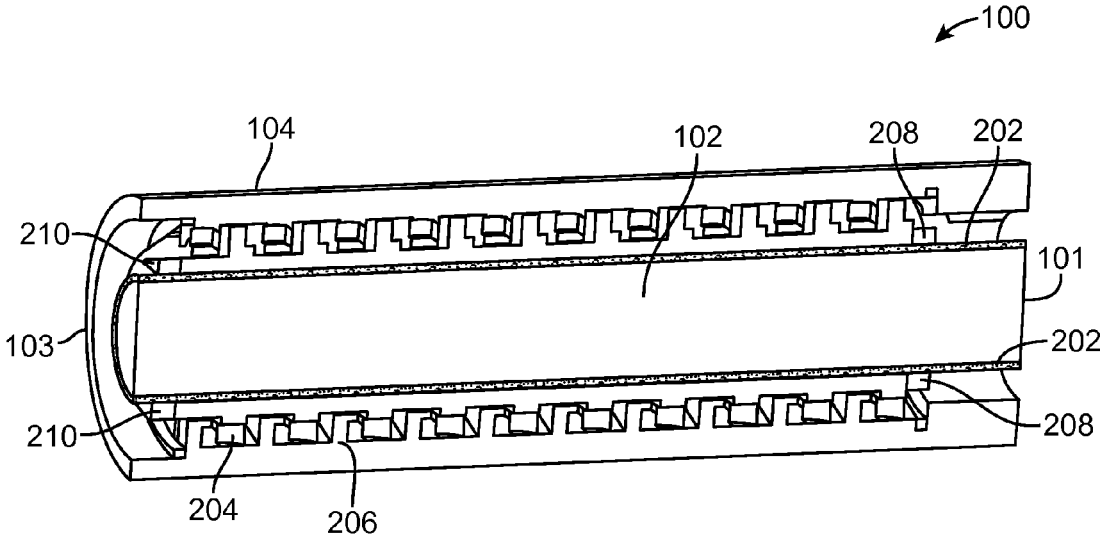
FIG. 3 is a partial view of a turbine with a non-conducting insulator in accordance with an exemplary embodiment.

Referring to FIG. 3, a partial view of a turbine with a non-conducting insulator in accordance with another exemplary embodiment is illustrated. As shown, the shaft 102 of the turbine 100 and/or the bores of the rotors 204 can be covered with a non-conducting insulator 202. The non-conducting insulator 202 can assist in reducing metal-on-metal contacts between an outer diameter of the shaft 102 and the bores of the shaft mounted components, for example, rotors 204. To further assist in reducing the leakage, a first non-conducting spacer 208 can be used to cover an outer surface of the shaft 102 at a first distal end of the motor 106 and a second non-conducting spacer 210 can be used to cover the outer surface of the shaft 102 at a second distal end of the motor 106. The non-conducting spacers 208, 210 can assist in reducing axial leakage along the motor 106. For example, the non-conducting spacers 208, 210 can assist in preventing an axial electrical flow path along the rotors 204 and/or stators 206 bypassing the non-conducting insulator 202 between them and the shaft 102 or turbine body 104.

Figure 4:
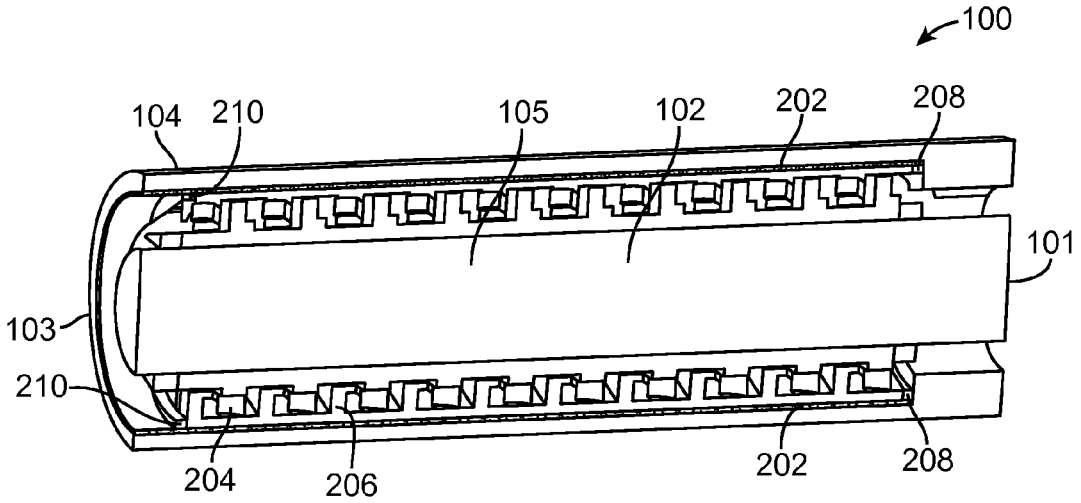
FIG. 4 is a partial view of a turbine with a non-conducting insulator in accordance with another exemplary embodiment.

Referring to FIG. 4, a partial view of a turbine with a non-conducting insulator in accordance with another exemplary embodiment. As shown, a non-conducting insulator 202 can be applied between the stators 206 and the turbine body 104. The non-conducting insulator 202 can assist in reducing metal-on-metal contacts between an inner surface of the turbine body 104 and the stators 206. To further assist in reducing the leakage, a first non-conducting spacer 208 can be used to insulate an inner surface of the turbine body 104 at a first distal end of the motor 106 and a second non-conducting spacer 210 can be used to insulate the inner surface of the turbine body 104 at a second distal end of the motor 106. The non-conducting spacers 208, 210 can assist in reducing axial leakage along the motor 106. For example, the non-conducting spacers 208, 210 can assist in preventing an axial electrical flow path along the rotors 204 and/or stators 206 bypassing the non-conducting insulator 202 between them and the shaft 102 or turbine body 104.

Figure 5:
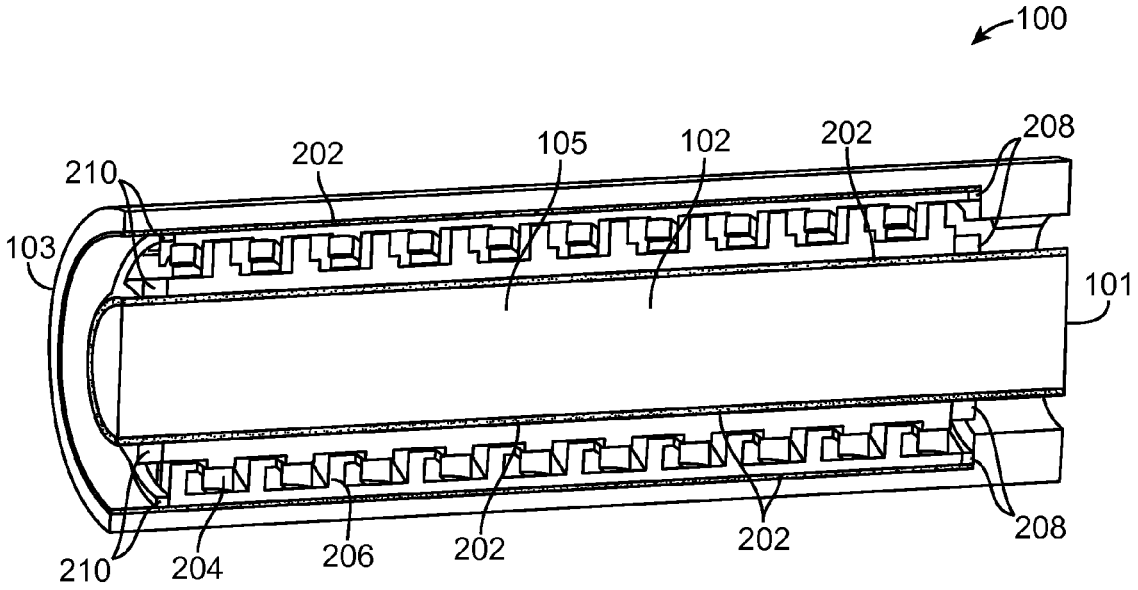
FIG. 5 is a partial view of a turbine with non-conducting insulators in accordance with yet another exemplary embodiment.

Referring to FIG. 5, a partial view of a turbine with non-conducting insulators in accordance with yet another exemplary embodiment is illustrated. As shown, the shaft 102 of the turbine 100 and/or the bores of the rotors 204 can be coated with a non-conducting insulator 202, for example, a non-conducting coating, and a non-conducting insulator 202, for example, a non-conducting coating, can be applied between the stators 206 and the turbine body 104. The non-conducting insulators 202 can assist in reducing metal-on-metal contacts between an outer diameter of the shaft 102 and the bores of the shaft mounted components, for example, rotors 204, and can assist in reducing metal-on-metal contacts between an inner surface of the turbine body 104 and the stators 206. To further assist in reducing the leakage, first non-conducting spacers 208 can be used to cover an outer surface of the shaft and to insulate an inner surface of the turbine body 104 at a first distal end of the motor 106 and second non-conducting spacers 210 can be used to cover an outer surface of the shaft and to insulate the inner surface of the turbine body 104 at a second distal end of the motor 106. The non-conducting spacers 208, 210 can assist in reducing axial leakage along the motor 106. For example, the non-conducting spacers 208, 210 can assist in preventing an axial electrical flow path along the rotors 204 and/or stators 206 bypassing the non-conducting insulator 202 between them and the shaft 102 or turbine body 104.

Figure 6:
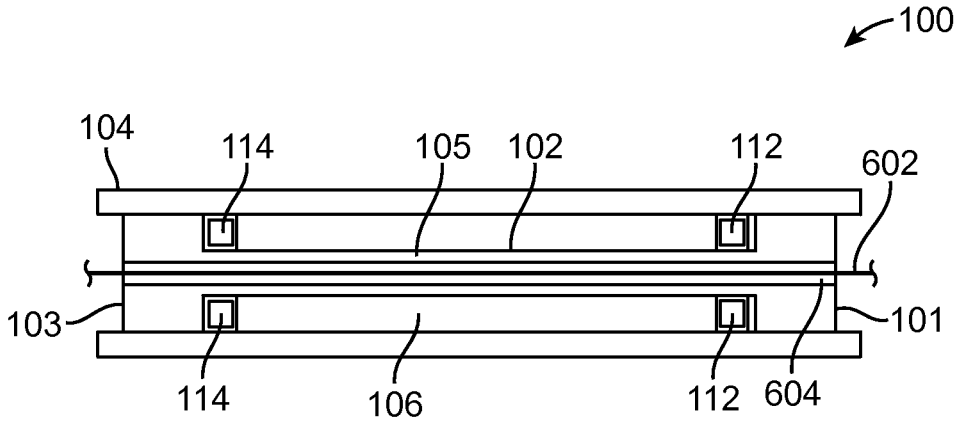
FIG. 6 is a partial view of a turbine with a conductor residing in a channel of the shaft in accordance with an exemplary embodiment.
Figure 7:
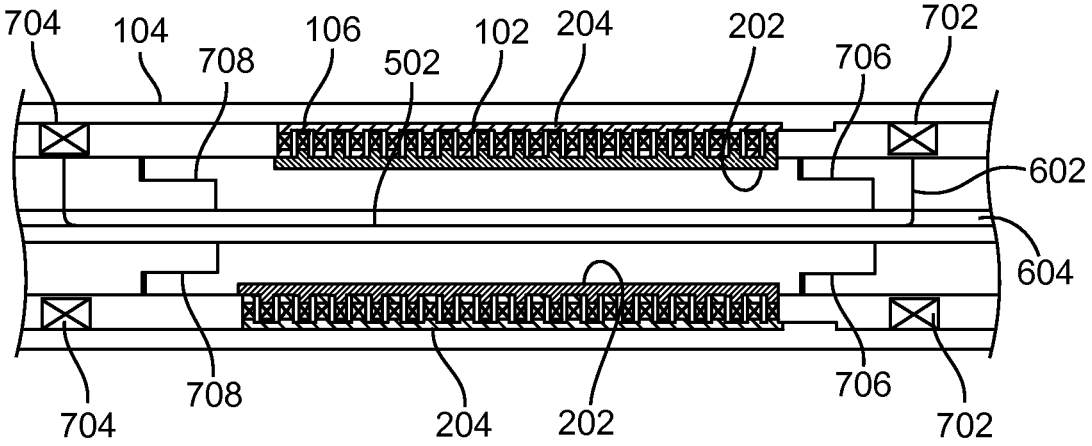
FIG. 7 is a partial view of a turbine with a conductor residing in a channel of the shaft in accordance with another exemplary embodiment.

Referring to FIGS. 6 and 7, partial views of a turbine with a conductor residing in a channel of the shaft in accordance with exemplary embodiments are illustrated. As shown, the shaft 102 can include a channel 604 with a conductor 602 residing in the channel 604. For example, the channel 604 can be created by drilling the shaft 102 at about the center of the shaft 102. The conductor 602 can be an insulated wire or wires. The conductor 602 can be used to transmit the data, for example, sensor data, across the motor 106, for example, the rotor/stator bundle. As shown, in FIG. 6 and described above with respect to FIG. 2, a first inductive loop 112 can be used to induce a signal on the conductor 502 and a second inductive loop 114 can be used to receive the signal from the conductor 502.

As shown in FIG. 7, the conductor 502 can provide a conductive path across the motor 106, for example, the rotor/stator bundle. The conductor 502 can be communicatively coupled at a first end which is downhole from the motor 106 and at a second end which is uphole from the motor 106. As shown, the first end of the conductor 502 can be communicatively coupled to the shaft 102 at a lower end at about a lower toroid 702 and communicatively coupled to the shaft 102 at an upper end at about an upper toroid 704. In one or more embodiments, the conductor 502 can be communicatively coupled to the turbine body 104 at the first end and/or second end. In one or more embodiments, the conductor 502 can be communicatively coupled to either the shaft 102 and/or turbine 104 at positions other than at about the lower toroid 702 and/or upper toroid 704. Sensor data can be induced onto conductor 502 in a similar manner as previously described.

The motor 106, for example, rotor/stator bundle, can be electrically isolated from the lower and upper shaft portions. The conductor 502 can eliminate the need to use a non-conducting insulator 202 along the full length of the shaft 104 or rotor bores 204 or turbine body 104 thereby simplifying the arrangement. As shown, an insulated lower shaft joint 706 and an insulated upper shaft joint 708 can assist in electrically isolating the motor 106. For example, a non-conducting insulator 202 can insulate the shaft joints 706, 708. In one or more embodiments, the rotors 204 can include a non-conducting insulator 202. For example, the non-conducting insulator 202 can cover the rotor bores 204.

Figure 8:
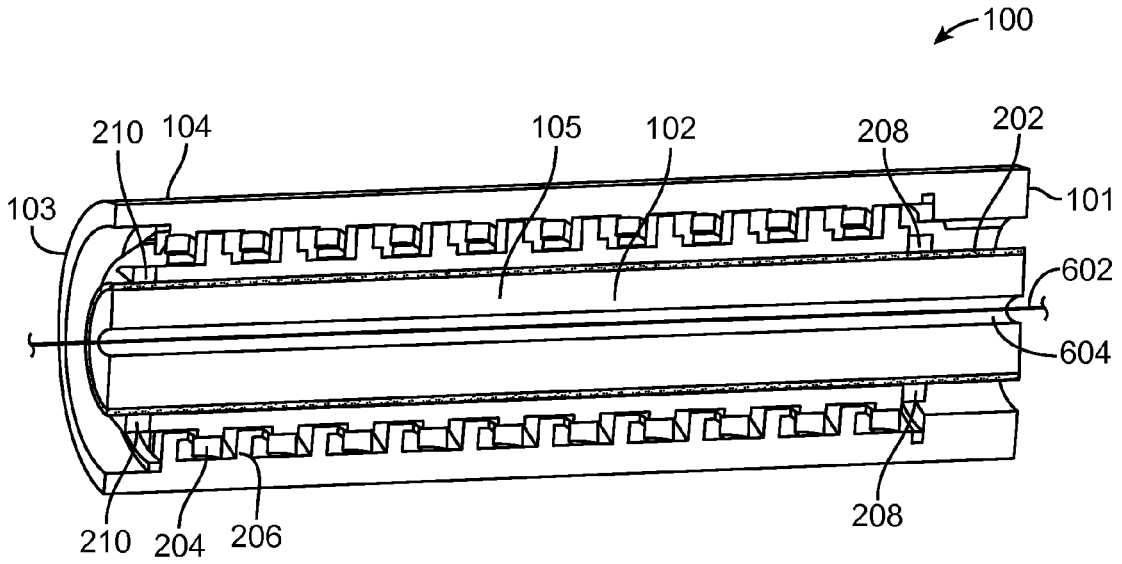
FIG. 8 is a partial view of a turbine with a non-conducting insulator and a conductor residing in a channel of the shaft in accordance with an exemplary embodiment.
Figure 9:
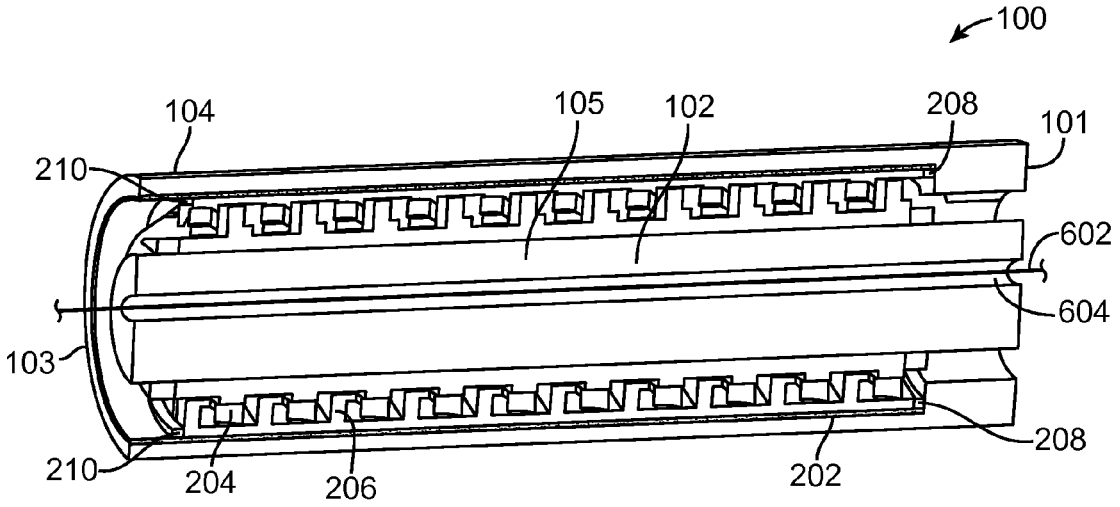
FIG. 9 is a partial view of a turbine with a non-conducting insulator and a conductor residing in a channel of the shaft in accordance with another exemplary embodiment.
Figure 10:
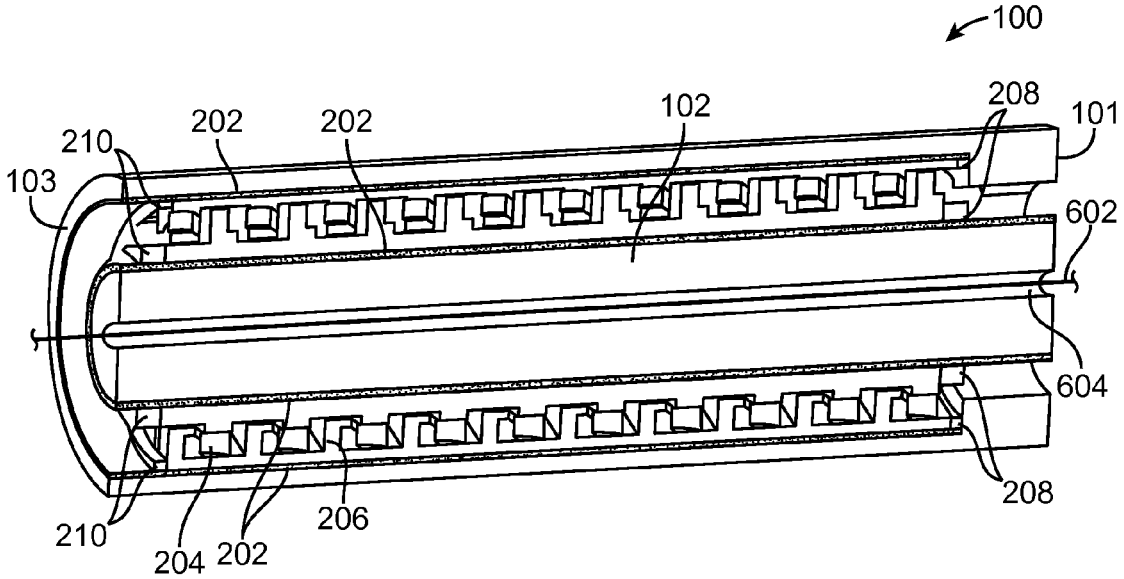
FIG. 10 is a partial view of a turbine with a non-conducting insulator and a conductor residing in a channel of the shaft in accordance with yet another exemplary embodiment.

Referring to FIGS. 8-10, partial views of a turbine with one or more non-conducting insulators and a conductor residing in a channel of the shaft in accordance with exemplary embodiments are illustrated. As shown, the shaft 102 of the turbine 100 and/or the bores of the rotors 204 can be coated with a non-conducting insulator 202, for example, a non-conducting coating, and/or a non-conducting insulator 202, for example, a non-conducting coating, can be applied between the stators 206 and the turbine body 104. The non-conducting insulators 202 can assist in reducing metal-on-metal contacts between an outer diameter of the shaft 102 and the bores of the shaft mounted components, for example, rotors 204, and can assist in reducing metal-on-metal contacts between an inner surface of the turbine body 104 and the stators 206. To further assist in reducing the leakage, one or more first non-conducting spacers 208 can be used to cover an outer surface of the shaft and/or to insulate an inner surface of the turbine body 104 at a first distal end of the motor 106 and/or one or more second non-conducting spacers 210 can be used to cover an outer surface of the shaft and/or to insulate the inner surface of the turbine body 104 at a second distal end of the motor 106. The non-conducting spacers 208, 210 can assist in reducing axial leakage along the motor 106. For example, the non-conducting spacers 208, 210 can assist in preventing an axial electrical flow path along the rotors 204 and/or stators 206 bypassing the non-conducting insulator 202 between them and the shaft 102 or turbine body 104.

Figure 11A:
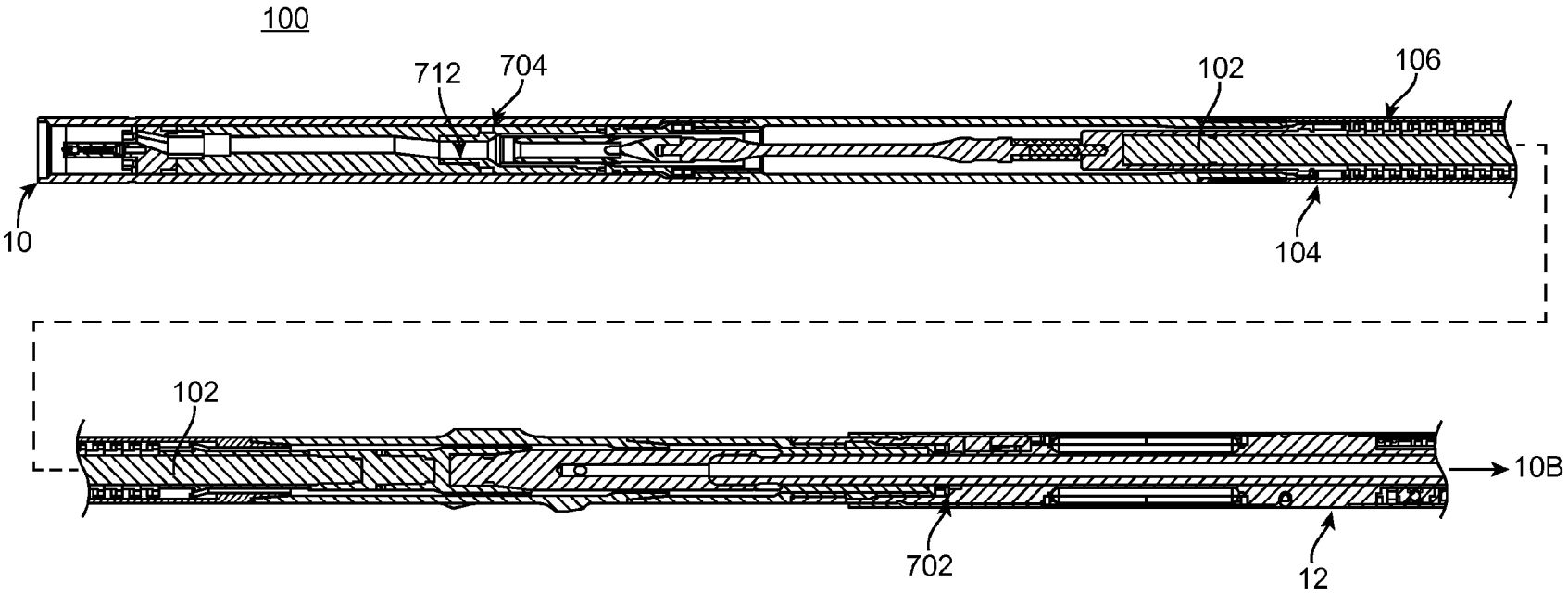
FIGS. 11A-11B are partial views of a block diagram of a turbine in accordance with an exemplary embodiment.
Figure 11B:
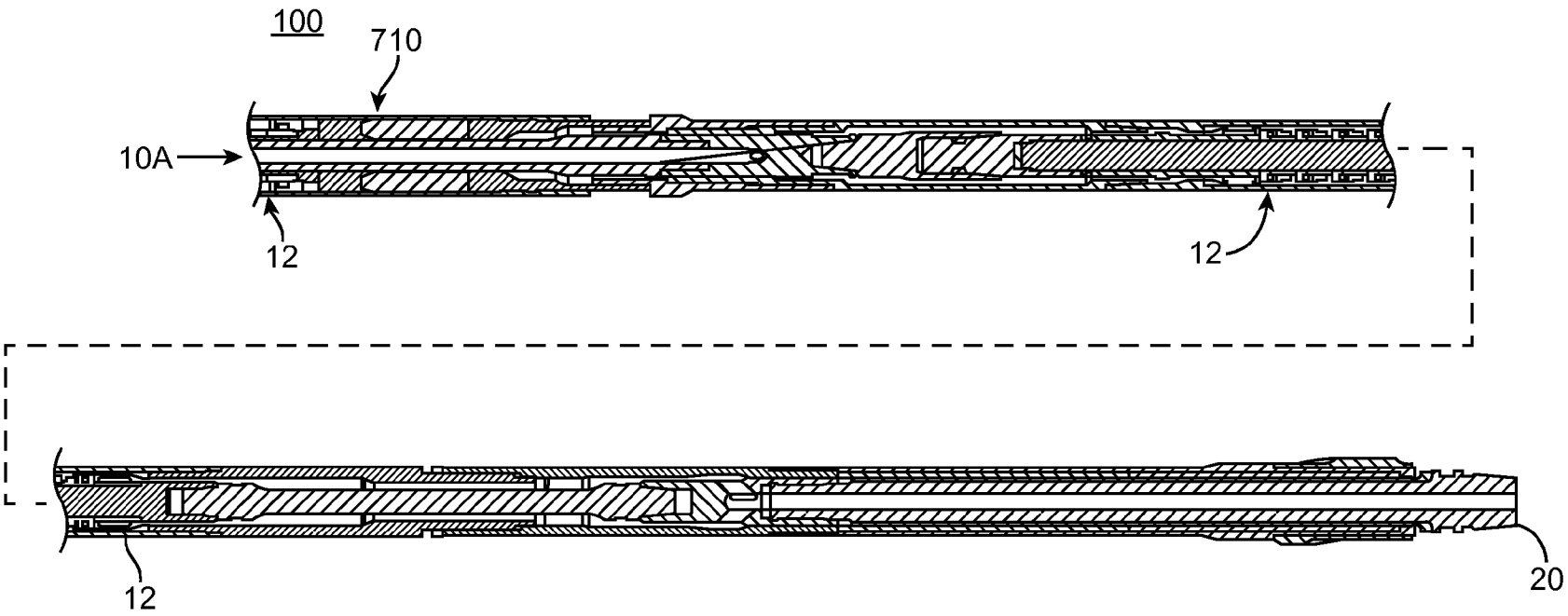

Referring to FIGS. 11A and 11B, partial cross-sectional views of a turbine 100 are illustrated in accordance with an exemplary embodiment of the current disclosure. As shown, the turbine 100 can have multiple components that are coupled together to form a turbine 100. In other embodiments, the turbine 100 can omit one or more of the components illustrated in FIGS. 11A and 11B. As shown in FIG. 11A, the turbine 100 has an uphole end 10. The turbine 100 can include a coupling device at the uphole end 10 to allow the turbine to be coupled to a drillstring located uphole of the turbine. The turbine 10 can include one or more sensor units 12. The one or more sensor units 12 can be communicatively coupled to a sensor transmitter 710. For example, the turbine 10 can include a sensor transmitter 710, that is located near the downhole end 20 of the turbine 10 and sensor receiver 712, that is located near the uphole end 10 of the turbine 100. The sensor receiver 712 can be a transceiver, for example, having a receiver and a transmitter, such as a MWD. The turbine can also include a shaft 102 that is surrounded by rotors and stators as described above.

As illustrated the shaft 102, turbines and rotors can continue for a predetermined distance, which is not illustrated. For example, the shaft 102 can run a substantial majority of the length of the turbine 100. In other embodiments, the shaft 102 can be about half the length of the turbine 100. In yet another embodiment, the shaft 102 can be about two-thirds the length of the turbine 100. The configuration of the shaft 102, stators, and rotors can be as described herein.

The turbine 100 can include one or more sensor units 12 that are located along the turbine 100. These sensor units 12 can provide data regarding drilling of the formation. The one or more sensor units 12 can be communicatively coupled in any suitable position but are typically contained downhole from the motor 106. It is understood that the electrical return path from the rotating shaft to the body is arranged such that these points are above and below the upper and lower toroids, the electrical contact path (in this embodiment) between the rotating and non-rotating components is via radial contact bearings (not shown).

As described above, one or more non-conducting insulators 202 and/or one or more non-conducting spacers 208, 210 can be utilized. In one or more embodiments, the one or more non-conducting insulators 202 and/or the one or more non-conducting spacers 208, 210 can be a non-conducting coating or non-conducting sleeve. For example, the coating can be Scotchkote™ Fusion-bonded epoxy 134 by 3M of St. Paul, Minn. or any other suitable material. In one or more embodiments, the non-conducting sleeve can be nylon, plastic, ceramic, glass or other suitable non-conducting material. In one or more embodiments, the sleeve can be a coated with a non-conductive material, such as Scotchkote™ Fusion-bonded epoxy 134. The effect of the non-conducting insulator 202 can be further enhanced by the use of a non-conducting lubricant between the contact surfaces.

In one or more embodiments, a non-conducting lubricant can be used to reduce the metal-on-metal contacts between the different components. However, in one or more implementations conductive lubricant, such as drilling fluid having a high chloride content which can cause the lubricant to be conductive, can be used. To further reduce conduction, one or more of the metal components can be covered with a non-conducting insulator 202, such as Scothkote™ Fusion-bonded epoxy 134.

Other components have not been described in full detail so as to not obscure the details of the present technology as it relates to the claimed subject matter.

The embodiments shown and described above are only examples. Many details are often found in the art such as the other features of a logging system. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A downhole turbine having a first end and a second end with the first end and the second end being opposite one another, the turbine comprising:

a turbine body;

a shaft positioned at about the center of the turbine body;

a motor comprising a plurality of rotors, stators and bearings interposed between the shaft and the turbine body, the motor interposed between the first end and the second end of the turbine, the plurality of rotors and stators disposed radially about the circumference of the shaft arranged in alternating successive concentric rows, each row one below the other along a longitudinal length of the shaft, the successive rows of rotors rotatable within apertures formed by the successive rows of stators; and at least one non-conductor insulator assisting in electrically isolating the shaft and the turbine body from one another, wherein the non-conductor insulator is a non-conducting coating extending along an entire length interposed between the turbine body and each of the plurality of rotors, stators and bearings, or extending along an entire length interposed between the shaft and each of the plurality of rotors, stators and bearings.

2. The turbine of claim 1 further comprising:

a sensor unit configured to generate sensor data; and a sensor transmitter communicatively coupled to the sensor unit and configured to transmit the generated sensor data to a first end of the motor via the shaft.

3. The turbine of claim 2 further comprising:

a first inductive loop interposed between the motor and the sensor transmitter, the first inductive loop configured to induce a current on the shaft; and a second inductive loop interposed between the motor and a receiver, the second inductive loop configured to inversely induce the current from the shaft, with the current representing the generated sensor data.

4. The turbine of claim 3 wherein each of the first inductive loop and the second inductive loop is one of an inductive coil and a slip ring.

5. The turbine of claim 3 further comprising a data transmitter interposed between the second inductive loop and the second end of the turbine, the data transmitter communicatively coupled to the second inductive loop and configured to transmit the generated sensor data.

6. The turbine of claim 5 wherein the data transmitter is a measurement while drilling (MWD) transmitter.

7. The turbine of claim 2 wherein the sensor unit is located at about the motor.

8. The turbine of claim 7 wherein the generated sensor data is related to the motor.

9. The turbine of claim 2 wherein the sensor unit is interposed between the motor and the first end of the turbine with the first end of the turbine being down hole from the second end of the turbine when the turbine is inserted in a down hole.

10. The turbine of claim 9 wherein the generated sensor data represents at least one of formation parameters and tool operating parameters.

11. The turbine of claim 2 wherein the non-conducting coating is on an outer surface of the shaft.

12. The turbine of claim 2 further comprising a first non-conducting spacer covering an outer surface of the shaft at a first distal end of the motor and a second non-conducting spacer covering the outer surface of the shaft at a second distal end of the motor.

13. The turbine of claim 12 further comprising a non-conducting lubricant between contact surfaces of the plurality of rotors, stators and bearings.

14. The turbine of claim 2 wherein the non-conducting coating extending along the entire interface interposed between the turbine body and the plurality of rotors, stators and bearings comprises the non-conducting coating on bores of the rotors.

15. The turbine of claim 14 further comprising a first non-conducting spacer interposed between the turbine body and a first distal end of the motor and a second non-conducting spacer covering the turbine body at a second distal end of the motor.

16. The turbine of claim 15 further comprising a non-conducting lubricant between contact surfaces of the plurality of rotors, stators and bearings.

17. The turbine of claim 2 further comprising a conductor in a channel of the shaft, the conductor communicatively coupled to the sensor transmitter and to a data transmitter, wherein the sensor transmitter is interposed between the motor and the first end of the turbine with the first end of the turbine configured to be down hole from the second end of the turbine and the data transmitter interposed between the motor and the second end of the turbine with the second end of the turbine configured to be up hole from the motor.

18. The turbine of claim 17 wherein the conductor is one of an insulated wire and a plurality of insulated wires.

19. The turbine of claim 1 wherein the shaft is a motor shaft.

20. The turbine of claim 1 wherein the shaft is a rotating shaft.

* * * * *